US006832541B2

(12) United States Patent
Satou et al.

(10) Patent No.: US 6,832,541 B2
(45) Date of Patent: Dec. 21, 2004

(54) LINEAR ACTUATOR

(75) Inventors: Toshio Satou, Tsukuba (JP); Yoshiteru Ueno, Yuki-gun (JP); Yoshihiro Toshimori, Moriya (JP); Akira Tadano, Tsuchiura (JP)

(73) Assignee: SMC Kabushiki Kaisha, Tokyo (JP)

( * ) Notice: Subject to any disclaimer, the term of this patent is extended or adjusted under 35 U.S.C. 154(b) by 48 days.

(21) Appl. No.: 10/355,095

(22) Filed: Jan. 31, 2003

(65) Prior Publication Data

US 2003/0140782 A1 Jul. 31, 2003

(30) Foreign Application Priority Data

Jan. 31, 2002 (JP) ..... 2002-022878

(51) Int. Cl.[7] ..... F01B 29/00
(52) U.S. Cl. ..... 92/88
(58) Field of Search ..... 92/88, 138, 161

(56) References Cited

U.S. PATENT DOCUMENTS 2,472,647 A * 6/1949 Covins ..... 92/138
5,617,772 A 4/1997 Hosono et al.
5,884,549 A * 3/1999 Hosono et al. ..... 92/88
6,338,294 B1 * 1/2002 Wagner et al. ..... 92/88

FOREIGN PATENT DOCUMENTS

JP 8-152006 6/1996
JP 2607486 6/2001

* cited by examiner

*Primary Examiner*—Edward K. Look
*Assistant Examiner*—Michael Leslie
(74) *Attorney, Agent, or Firm*—Paul A. Guss

(57) ABSTRACT

A linear actuator comprises a piston which is provided in an actuator body and which is displaceable under a pressure fluid, a slide table which is integrally connected to the piston and which is linearly displaceable, a rod which is engaged with the slide table and which has a shaft section inserted into an engagement hole of the piston, end blocks which are connected to ends of the actuator body, and stoppers which are provided on end surfaces of the end blocks and which adjust a displacement amount of the slide table.

19 Claims, 13 Drawing Sheets

LINEAR ACTUATOR

BACKGROUND OF THE INVENTION

1. Field of the Invention

The present invention relates to a linear actuator for effecting reciprocating motion of a slider in an axial direction of an actuator body by introducing a pressure fluid from either of fluid inlet/outlet ports.

2. Description of the Related Art

A conventional linear actuator has been used as a means for transporting a workpiece or the like.

For example, Japanese Utility Model Registration Publication No. 2607486 discloses a linear actuator concerning a conventional technique. As shown in FIG. 13, the linear actuator 1 comprises a pair of cylinder chambers 3*a*, 3*b* which are formed in a main cylinder body 2. A long hole 4, which is communicated with the cylinder chambers 3*a*, 3*b*, is formed to penetrate from the upper surface of the main cylinder body 2 to the lower surface of the main cylinder body 2 so that the long hole 4 is perpendicular to the axis of the main cylinder body 2. A pair of pistons 5*a*, 5*b* is independent from each other. Each of the pistons 5*a*, 5*b* is slidably inserted into the cylinder chambers 3*a*, 3*b* respectively. A rod 6, which is inserted in the vertical direction from a lower portion of the main cylinder body 2, is interposed between the pair of pistons 5*a*, 5*b*.

The rod 6 is integrally connected to a table 7 which is arranged displaceably in the axial direction on the upper surface of the main cylinder body 2. Each of end covers 8*a*, 8*b*, which close the cylinder chambers 3*a*, 3*b*, is installed to opposite ends of the main cylinder body 2 respectively.

However, in the case of the linear actuator 1 concerning the conventional technique as described above, it is demanded that the number of parts is reduced in order to reduce the cost of the linear actuator 1 and improve the assembling operability for the linear actuator 1.

Further, the long hole 4 penetrates as far as the lower surface of the main cylinder body 2, while the long hole 4 is open at the lower surface. Therefore, any dust or the like enters the cylinder chambers 3*a*, 3*b* via the long hole 4 from the outside of the main cylinder body 2. Further, any dust or the like, which is generated in the cylinder chambers 3*a*, 3*b*, is discharged to the outside via the long hole 4.

A finish machining may be applied to the inner circumferential surfaces of the cylinder chambers 3*a*, 3*b* in order to reduce the sliding resistance of the outer circumferential surfaces of the sliding pistons 5*a*, 5*b*. However, the machining operation to the finish machining is complicated, and the machining cost thereto is expensive.

SUMMARY OF THE INVENTION

A first object of the present invention is to provide a linear actuator which can be produced inexpensively by simplifying the structure thereof.

A second object of the present invention is to provide a linear actuator so that it possible to improve the assembling operability for the linear actuator.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
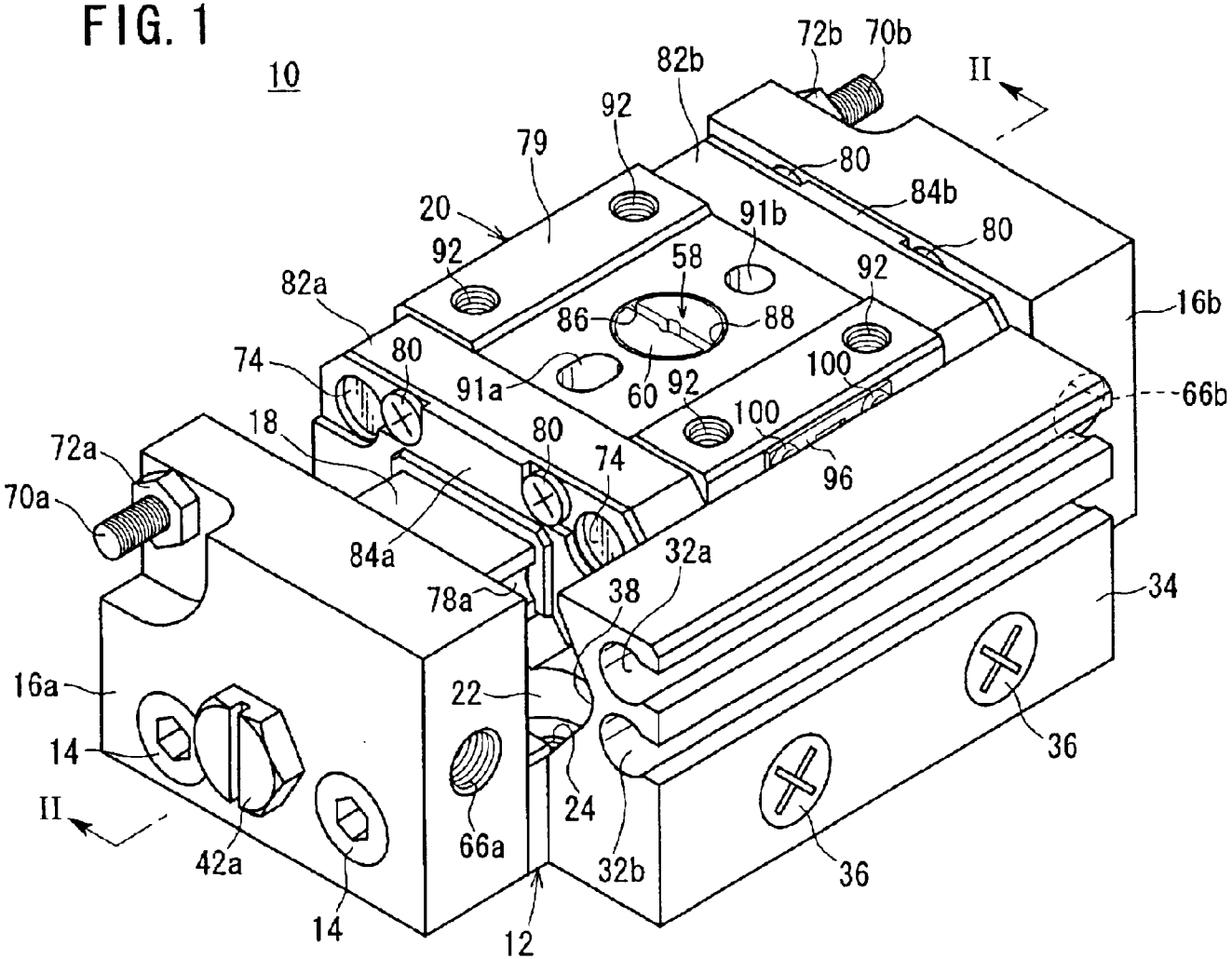
FIG. 1 is a perspective view illustrating a linear actuator according to an embodiment of the present invention.

As shown in FIG. 1, reference numeral 10 indicates a linear actuator according to an embodiment of the present invention.

The linear actuator 10 basically comprises an actuator body (body) 12 which is formed as the shape of rectangular parallelepiped, a pair of end blocks 16*a*, 16*b* which are connected to both ends of the actuator body 12 in the axial direction of the actuator body 12 by screws 14, and a slide table (slider) 20 which makes rectilinear reciprocating motion along a guide section 18 which is formed integrally with the actuator body 12 and projects on the upper surface of the actuator body 12.

Figure 5:
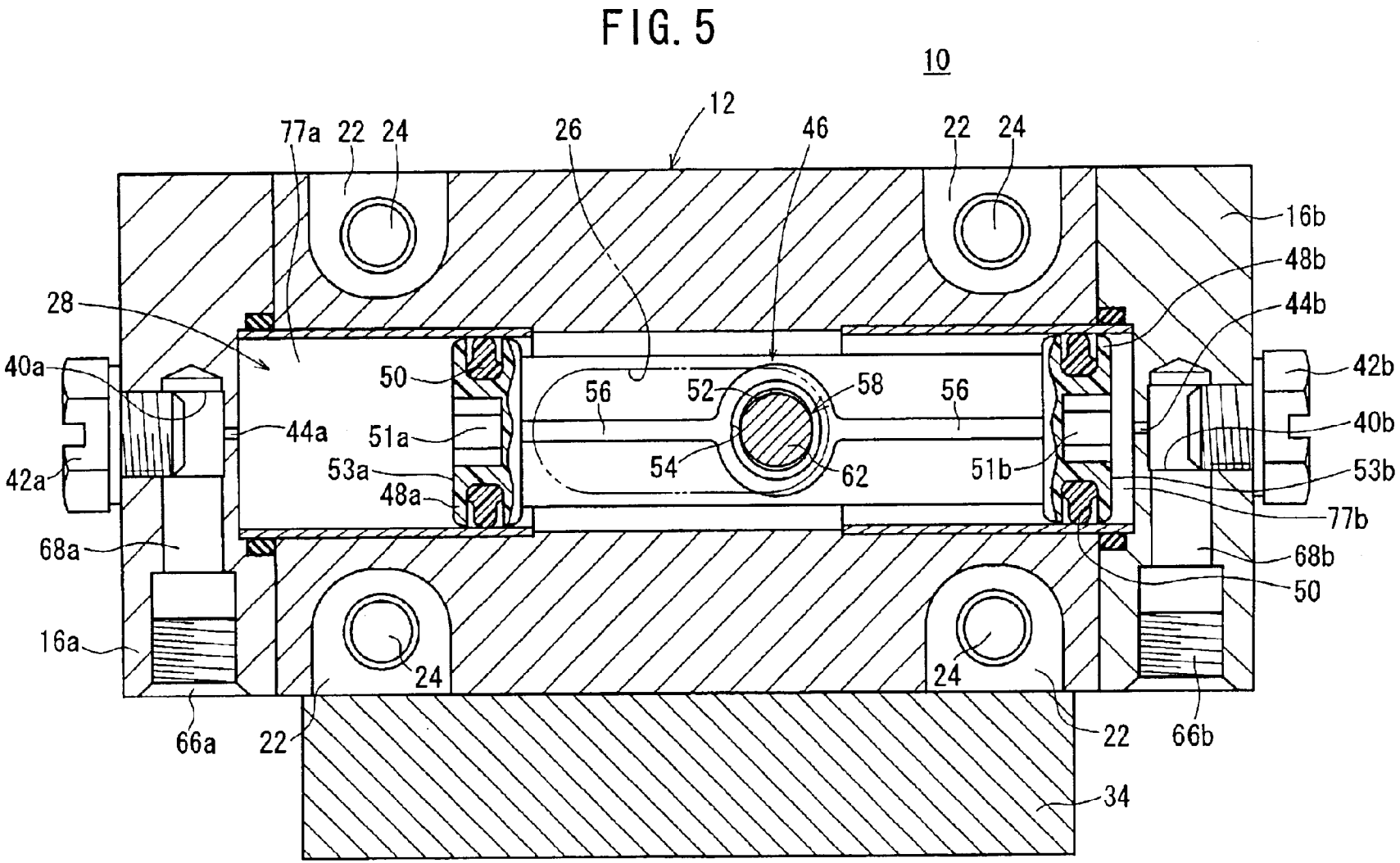
FIG. 5 is a partial lateral sectional view illustrating a state removed a slide table from the linear actuator shown in FIG. 1.

Substantially semielliptical cutouts 22 are formed at four positions on the upper surface of the actuator body 12. Attachment holes 24, which penetrate from the upper surface of the actuator body 12 to the bottom surface of the actuator body 12, are formed in the cutouts 22 (see FIGS. 5 and 8). A substantially elliptical opening 26, through which a rod 58 is displaceable as described later on, is formed on the upper surface of the actuator body 12 (see FIGS. 2 and 10).

Figure 2:
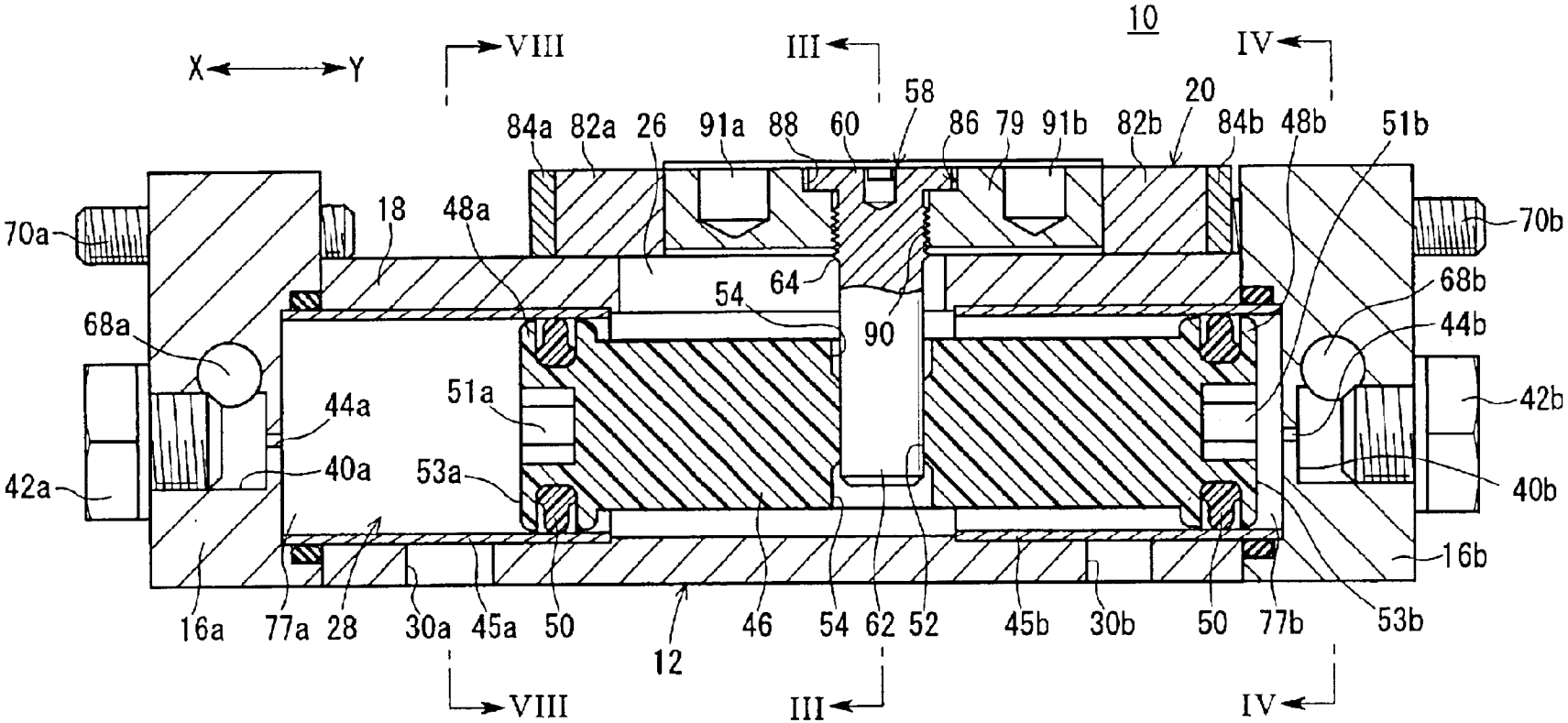
FIG. 2 is a longitudinal sectional view along a line II—II shown in FIG. 1.
Figure 7:
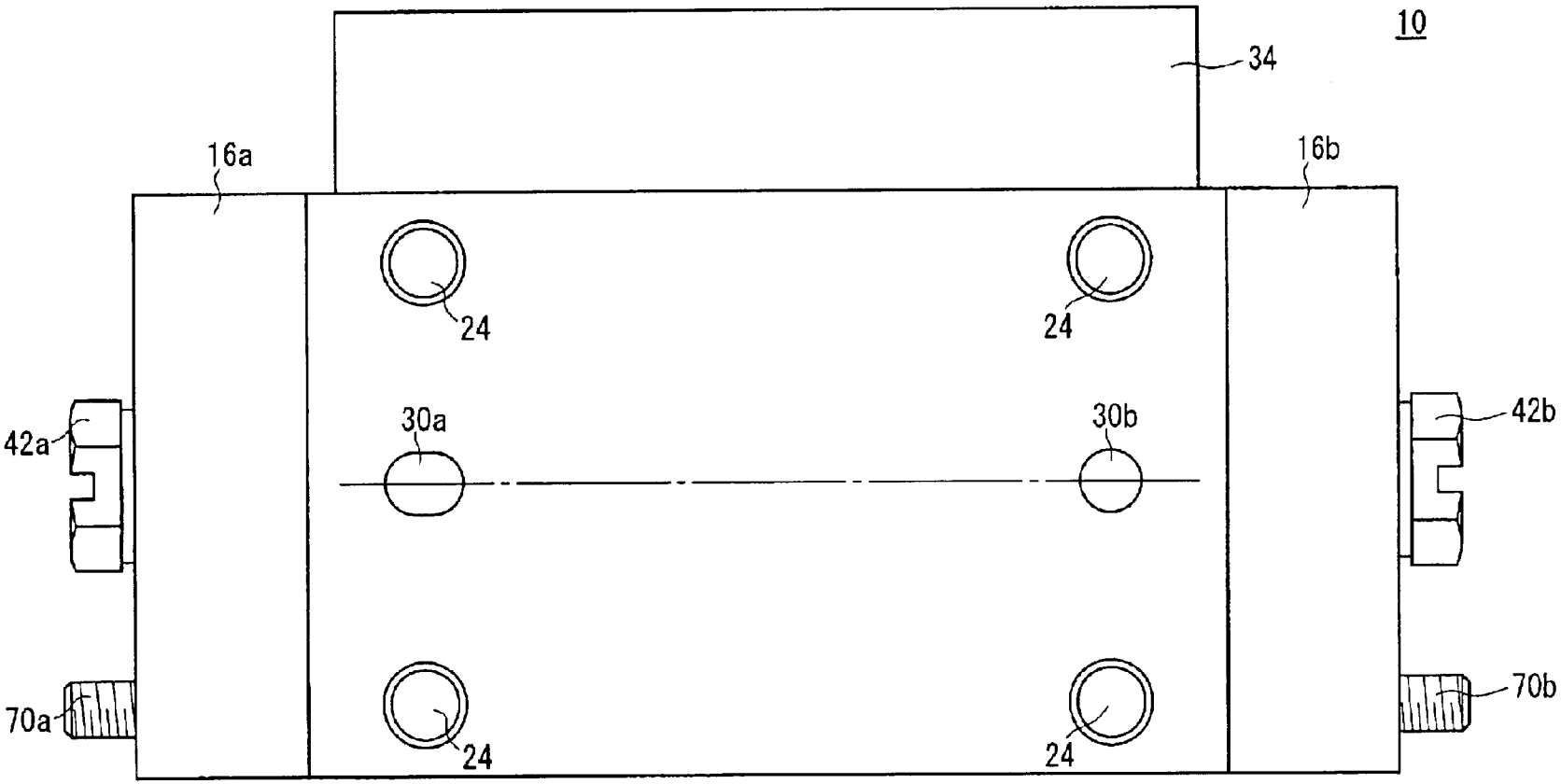
FIG. 7 is a bottom view illustrating the linear actuator shown in FIG. 1.

Further, as shown in FIG. 2, a through-hole 28 which has a substantially circular cross section in the actuator body 12, and which is communicated with the elliptical opening 26, is formed in the actuator body 12 along the axial direction of the actuator body 12. As shown in FIG. 7, a substantially elliptical positioning hole 30*a* and a substantially circular positioning hole 30*b* are formed on the same axis as the axis of the actuator body 12 on the bottom surface of the actuator body 12. The provision of the positioning holes 30*a*, 30*b* is possible to reliably position the linear actuator 10 by positioning pins or the like (not shown) provided on a unillustrated plane, for example, when the linear actuator 10 is installed on the unillustrated plane.

As shown in FIG. 1, a rail member 34 is installed to the side surface of the actuator body 12 by screws 36 engaged with screw holes 35 (see FIG. 10) of the actuator body 12. Two stripes of sensor attachment grooves 32*a*, 32*b*, which extend substantially in parallel in the axial direction of the rail member 34, are formed on the rail member 34.

Figure 3:
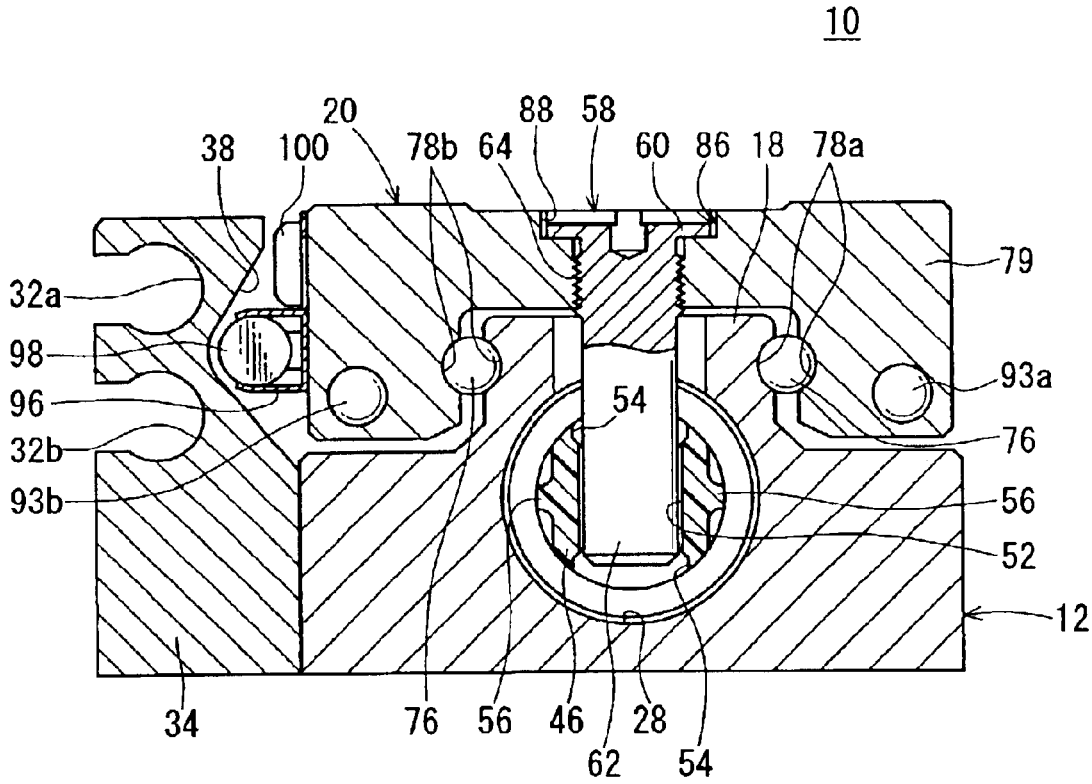
FIG. 3 is a vertical sectional view along a line III—III shown in FIG. 2.
Figure 4:
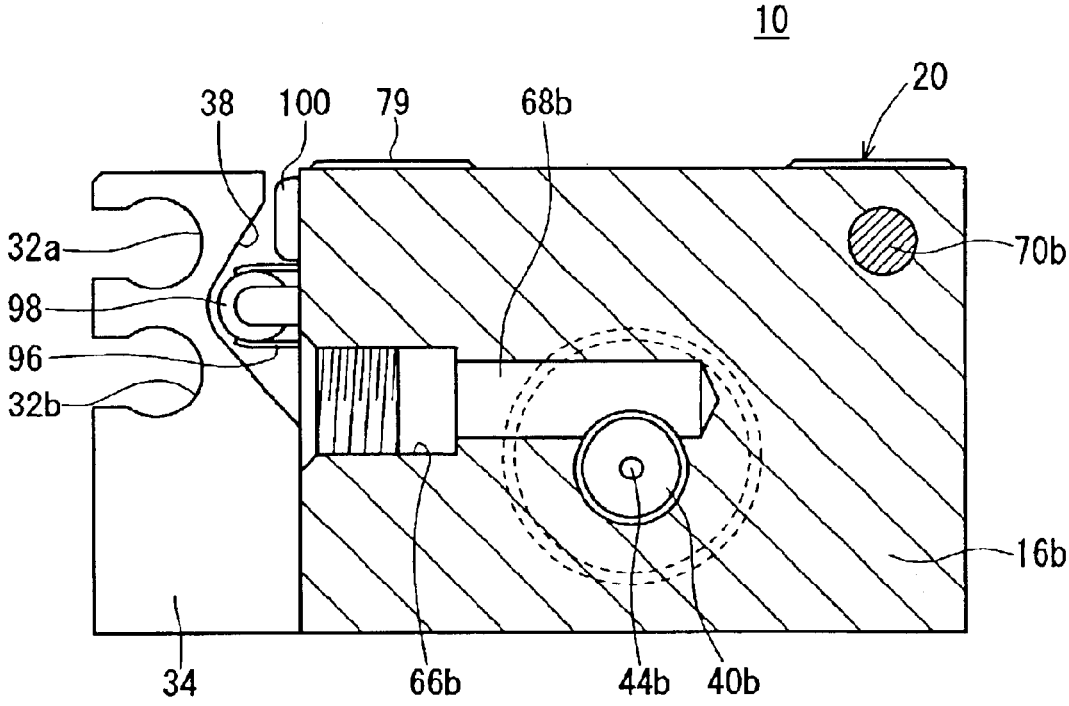
FIG. 4 is a vertical sectional view taken a line IV—IV shown in FIG. 2.

A recess 38, which has a triangular cross section, is formed in the axial direction of the rail member 34 on the side surface of the opposite side to the side surface of the rail member 34 on which the sensor attachment grooves 32*a*, 32*b* are formed (see FIGS. 3 and 4).

As shown in FIG. 2, screw holes 40*a*, 40*b* are formed in the axial direction of the actuator body 12 in the end blocks 16*a*, 16*b*. The screw holes 40*a*, 40*b* are closed by engaging with the screw holes 40*a*, 40*b* and plug members 42*a*, 42*b* having screw threads.

The screw holes 40*a*, 40*b* are communicated with fluid inlet/outlet ports 66*a*, 66*b* as described later on. Further, the screw holes 40*a*, 40*b* are communicated with the through-hole 28 via orifices 44*a*, 44*b* which are formed in the end blocks 16*a*, 16*b* toward pressure chambers 77*a*, 77*b*. A diameter of the orifices 44*a*, 44*b* is smaller than a diameter of the screw holes 40*a*, 40*b*, and the orifices 44*a*, 44*b* are formed in the axial direction of the screw holes 40*a*, 40*b*.

A pair of cylindrical members 45*a*, 45*b* are inserted close into the through-hole 28 of the actuator body 12 over ranges ranging from the elliptical opening 26 toward the end blocks 16*a*, 16*b* respectively. The cylindrical members 45*a*, 45*b* are formed to be thin-walled, and they are inserted close so that their ends protrude by predetermined lengths into the end blocks 16*a*, 16*b*.

It is noted that the positioning holes 30*a*, 30*b* of the actuator body 12 are closed by the cylindrical members 45*a*, 45*b*. Therefore, any dust or the like, which enters from the outside of the actuator body 12 into the actuator body 12, is prohibited from invasion into the through-hole 28 to cause the sliding resistance of a piston 46. Further, any dust or the like, which is generated in the through-hole 28, is prohibited from the discharge to the outside via the positioning holes 30*a*, 30*b*.

Figure 8:
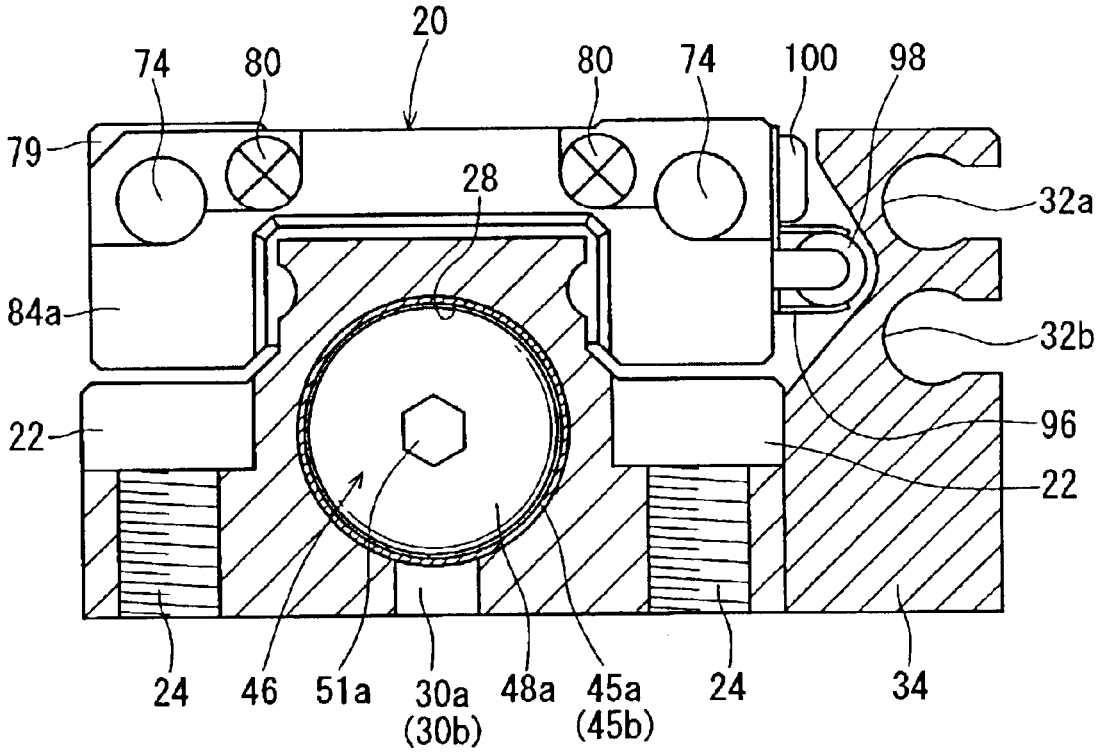
FIG. 8 is a vertical sectional view along a line VIII—VIII shown in FIG. 2.
Figure 9:
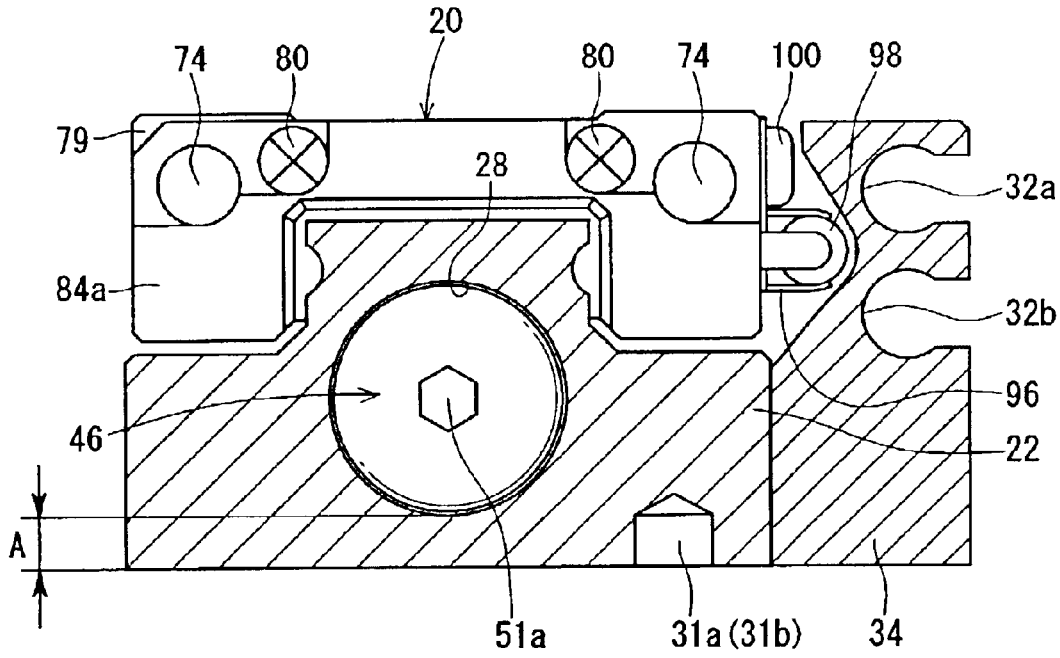
FIG. 9 is a vertical sectional view illustrating a linear actuator as a Comparative Example to the linear actuator shown in FIG. 8.

Next, a vertical sectional view of the linear actuator 10 according to the embodiment of the present invention is shown in FIG. 8, and a vertical sectional view of a linear actuator concerning Comparative Example in contrast to the linear actuator 10 is shown in FIG. 9. The same constitutive components of the linear actuator concerning Comparative Example shown in FIG. 9 as those of the linear actuator 10 according to the embodiment of the present invention are designated by the same reference numerals.

In general, in the case of the linear actuator concerning Comparative Example shown in FIG. 9, the wall thickness A between the through-hole 28 and the portion in the vicinity of the bottom surface of the actuator body 12 is formed to be thin as compared with the wall thicknesses between the through-hole 38 and the other portions of the actuator body 12. If the positioning hole 31*a* (31*b*) is formed on the bottom surface of the actuator body 12 along the axis on the bottom surface, then the positioning hole 31*a* (31*b*) penetrates to the through-hole 28, and the pressure fluid, which is supplied into the through-hole 28, may be leaked to the outside of the linear actuator 10 via the positioning hole 31*a* (31*b*).

For this reason, in the case of the linear actuator concerning the Comparative Example shown in FIG. 9, the positioning hole 31*a* (31*b*) is formed at a position which is separated by a predetermined spacing distance from the axis of the actuator body 12 at which the wall thickness is thicker than the wall thickness A.

However, any attachment orientation arises when the linear actuator is attached, because the positioning hole 31*a* (31*b*) is not positioned on the same axis as the axis of the actuator body 12. Therefore, it is complicate to set the position of an unillustrated positioning pin or the like to be provided on a plane on which the actuator body 12 is placed.

On the contrary, in the case of the linear actuator 10 according to the embodiment of the present invention shown in FIG. 8, when the positioning hole 30*a* (30*b*) is formed on the same axis as that of the actuator body 12, the positioning hole 30*a* (30*b*) is closed by the cylindrical member 45*a* (45*b*) which is provided in the through-hole 28. Accordingly, the air-tightness is reliably retained in the through-hole 28.

As shown in FIG. 7, when the positioning holes 30*a*, 30*b* are formed on the same axis as the axis of the actuator body 12 at the substantially central portions of the bottom surface of the actuator body 12, the shape of the actuator body 12 can be made symmetrical in relation to the center line through the center of the respective positioning holes 30*a*, 30*b*. As a result, it is unnecessary to consider the attachment orientation when the actuator body 12 is attached with respect to the unillustrated positioning pins on the plane. Thus, the positioning of the actuator body 12 can be performed conveniently.

The substantially cylindrical piston 46, which is movable in the axial direction of the actuator body 12 (in the direction of the arrow X or in the direction of the arrow Y as shown in FIG. 2) under the pressure fluid supplied into the pressure chambers 77*a*, 77*b* as described later on, is arranged in the cylindrical members 45*a*, 45*b*.

In the conventional technique, the finish machining has been applied to the inner circumferential surface of the through-hole 28 in order to suppress the sliding resistance of the piston 46. However, when the cylindrical members 45*a*, 45*b*, which are made of metal material and which are formed to be substantially cylindrical, are inserted close into the through-hole 28, it is unnecessary to apply the finish machining to the inner circumferential surface of the through-hole 28. As a result, it is unnecessary to perform the steps of the finish machining which are complicated and which require expensive cost. Therefore, it is possible to shorten the time required for the production of the linear actuator 10.

Figure 11:
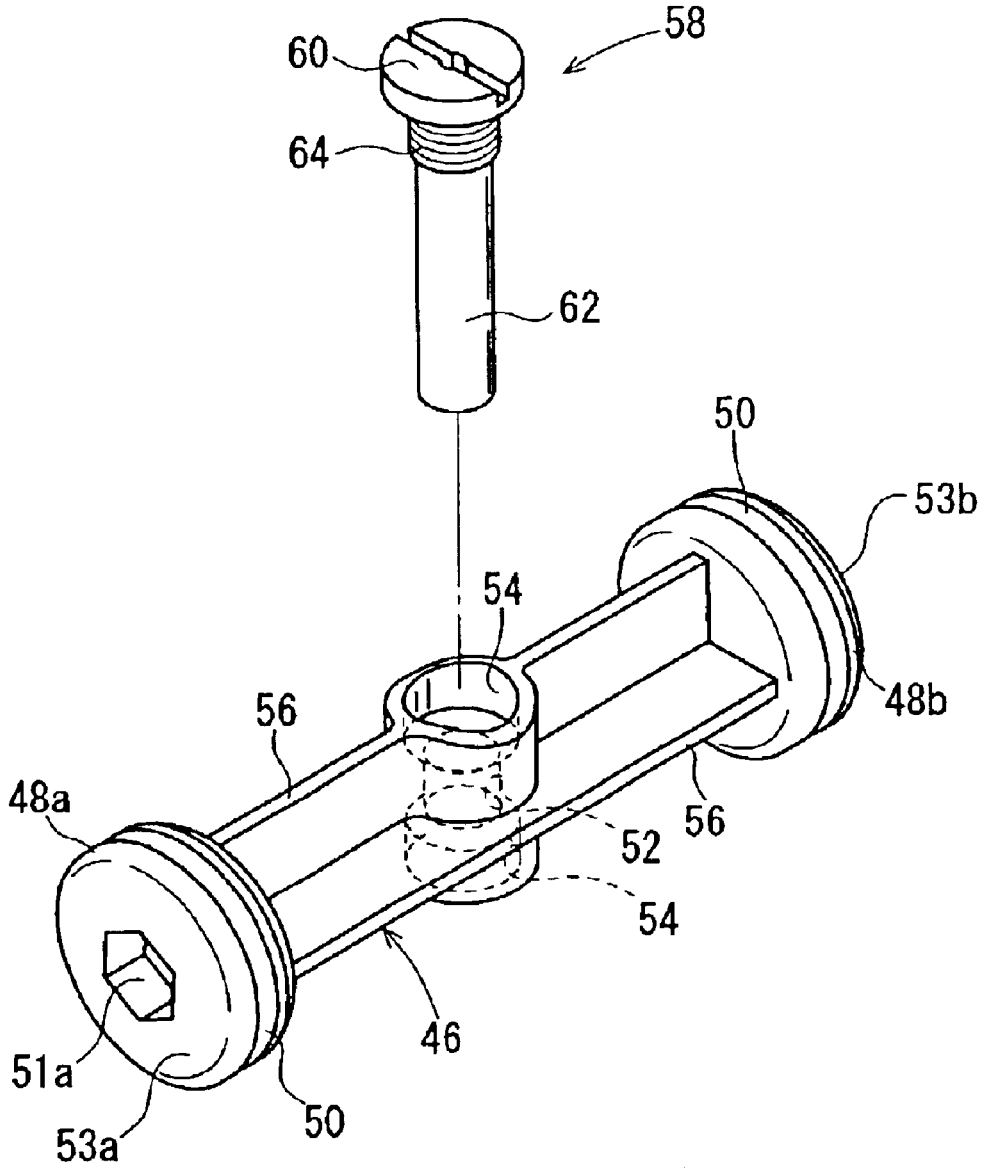
FIG. 11 is an exploded perspective view illustrating a rod and the piston of the linear actuator.

As shown in FIGS. 2 and 11, flange sections 48*a*, 48*b*, which have substantially equivalent diameters to the inner circumferential diameters of the cylindrical members 45*a*, 45*b*, are formed at both ends of the piston 46. The flange sections 48*a*, 48*b* slide along the inner circumferential surfaces of the cylindrical members 45*a*, 45*b*. Seal members 50 are installed to annular grooves disposed on the outer circumferential surfaces of the flange sections 48*a*, 48*b*. The outer circumferential surfaces of the seal members 50 abut against the inner circumferential surfaces of the cylindrical members 45*a*, 45*b*, and thus the air-tightness is retained in the pressure chambers 77*a*, 77*b*.

Adjusting holes 51*a*, 51*b*, which have non-circular (for example, hexagonal) cross sections, are formed at substantially central portions of the both end surfaces 53*a*, 53*b* of the piston 46 respectively. When the piston 46 is inserted into the cylindrical members 45*a*, 45*b*, the piston 46 is rotated in the circumferential direction of the cylindrical members 45*a*, 45*b* along the inner circumferential surfaces of the cylindrical members 45*a*, 45*b* by inserting and rotating an unillustrated tool into the adjusting holes 51*a*, 51*b*. As a result, when the rod 58, which is integrally connected to the slide table 20, is inserted into an engagement hole 52 as described later on, it is possible to reliably and conveniently adjust the position of the rod 58 and the position of the engagement hole 52 in the circumferential direction of the cylindrical member 45*a*, 45*b*. Accordingly, when the slide table 20 is assembled to the piston 46, a shaft 62 of the rod 58 can be easily inserted into the engagement hole 52 as described later on.

The engagement hole 52 is formed at the substantially central portion of the piston 46 so that the engagement hole 52 penetrates in the direction substantially perpendicular to the axial direction of the piston 46. Guide holes 54, which have diameters of predetermined lengths respectively, are formed at both ends of the engagement hole 52 in the axial direction of the engagement hole 52. The guide holes 54 are formed as a pair on both sides in the axial direction of the engagement hole 52. As a result, when the rod 58 is inserted into the guide holes 54, the rod 58 can be inserted into the guide holes 54 more easily.

Figure 6:
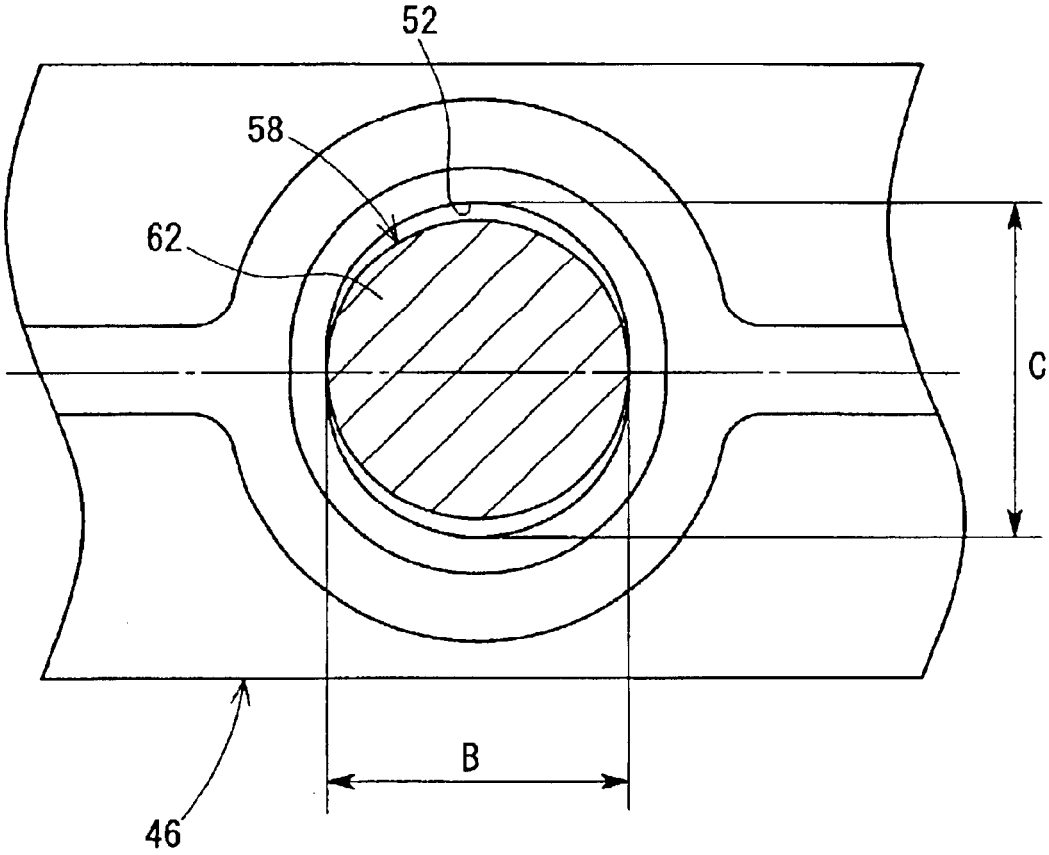
FIG. 6 is a partial omitted and partial enlarged view illustrating a piston inserted a shaft section into an engagement hole thereof.

As shown in FIG. 6, the engagement hole 52 is formed to have a substantially elliptical cross section. The size C in the direction substantially perpendicular to the axial direction of the piston 46 is formed to be slightly larger than the size B in the axial direction of the piston 46 (B<C).

Figure 13:
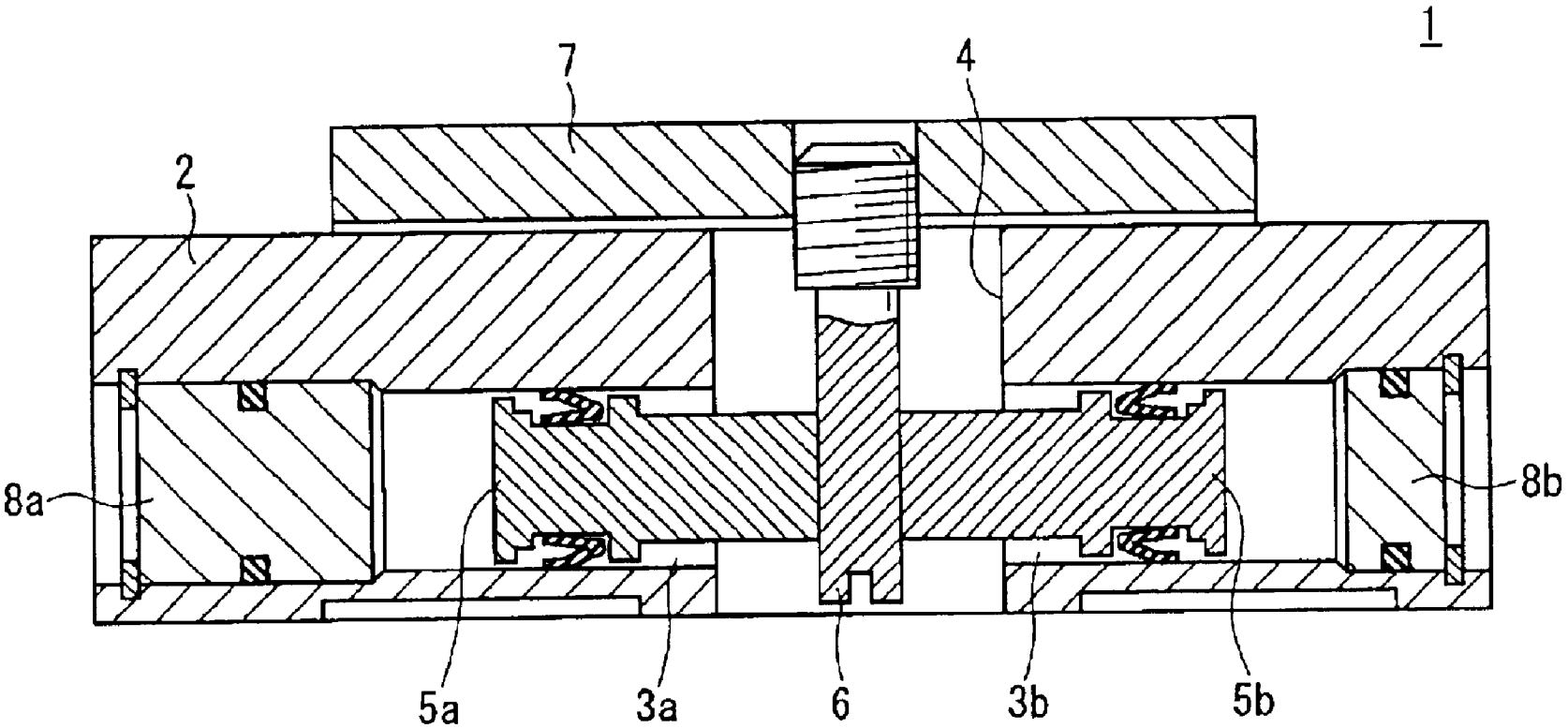
FIG. 13 is a longitudinal sectional view illustrating a linear actuator concerning the conventional technique.

For example, when the piston 46 and the slide table 20 are displaced, either of and/or both of the axes of the piston 46 and the slide table 20 are deviated and not coincident with each other in some cases. In such a situation, the table 7 for which the rod 6 is integrally connected to the conventional pistons 5*a*, 5*b* as shown in FIG. 13, cannot be displaced smoothly due to any sliding resistance to be generated on unillustrated track grooves of the table 7, on track grooves of an unillustrated guide section, and between ball bearings.

In the embodiment of the present invention, the engagement hole 52 has the substantially elliptical cross section to provide the clearance between the engagement hole 52 and the shaft section 62 of the rod 58. Accordingly, even when the slide table 20 and the piston 46 are not displaced on the same axis, the discrepancy of the displacement between the slide table 20 and the piston 46 can be absorbed by the clearance by the rod 58 which is connected to the slide table 20. As a result, no sliding resistance is generated when the slide table 20 is displaced, therefore it possible to effect the smooth displacement of the slide table 20.

In particular, the discrepancy of the displacement between the slide table 20 and the piston 46 is generated in a larger amount in the direction substantially perpendicular to the axial direction of the piston 46. Therefore, the engagement hole 52 is formed so that the size C in the direction substantially perpendicular to the axis is slightly larger than the size B in the axial direction of the piston 46 (B<C).

Alternatively, this structure may be formed such that the size B in the axial direction of the piston 46 is the same as the size C in the direction substantially perpendicular to the axis (B=C).

Further, the piston 46 made of resin material is formed integrally with a plurality of ribs 56 by the resin molding. The ribs 56 protrude by predetermined lengths radially outwardly, and are separated from each other by predetermined angles in the circumferential direction of the piston 46 (see FIGS. 3 and 11). When the ribs 56 are provided on the outer circumferential surface of the piston 46, it is possible to avoid any deformation which would be otherwise caused when the piston 46 is formed by the resin molding.

In the embodiment of the present invention, the inner circumferential surfaces of the cylindrical members 45*a*, 45*b* abut only against the ribs 56 as compared with a case in which the inner circumferential surfaces of the cylindrical members 45*a*, 45*b* abut against the entire outer circumferential surface of the piston 46. Thus, it is possible to realize a light weight of the outer circumferential portion of the piston 46.

Further, the side surfaces of the ribs 56 abut against the inner circumferential surfaces of the cylindrical members 45*a*, 45*b* to make the sliding movement. Accordingly, it is possible to suppress the sliding resistance when the piston 46 is displaced. The piston 46 is not limited to only the resin material. The piston 46 may be formed, for example, by the metal injection molding or the metal casting and the like. That is, if the engagement hole 52 of the piston 46 is formed by the cutting machining, the machining is complicated. Therefore, when the piston 46 is formed by the production method based on the use of the mold in place thereof, the piston 46 can be produced inexpensively and conveniently.

The piston 46 is not limited to the columnar shape. The piston 46 may be formed to have a variety of shapes provided that a pillar-shaped member is formed.

As shown in FIG. 11, a substantially disk-shaped head 60 is formed at one end of the rod 58 which is made of metal material. A shaft section 62, which is diametrally reduced as compared with the head 60, is formed at the other end of the rod 58. A screw thread 64 is formed between the head 60 and the shaft section 62, and it is screw-engaged with a rod attachment hole 86 of the slide table 20 as described later on. As a result, the slide table 20 and the rod 58 are integrally connected to one another.

As shown in FIG. 2, the shaft section 62 is inserted into the engagement hole 52 of the piston 46 via the elliptical opening 26 of the guide section 18. That is, the rod 58 is in a state of being fastened in the axial direction of the piston 46 with respect to the piston 46. The clearance is formed between the shaft section 62 and the engagement hole 52 by forming the rod 58 such that the diameter of the shaft section 62 of the rod 58 is slightly smaller than the diameter of the engagement hole 52. Owing to the clearance, when the slide table 20 is assembled to the piston 46, it is easy to insert the rod 58 into the engagement hole 52 via the guide hole 54.

Figure 10:
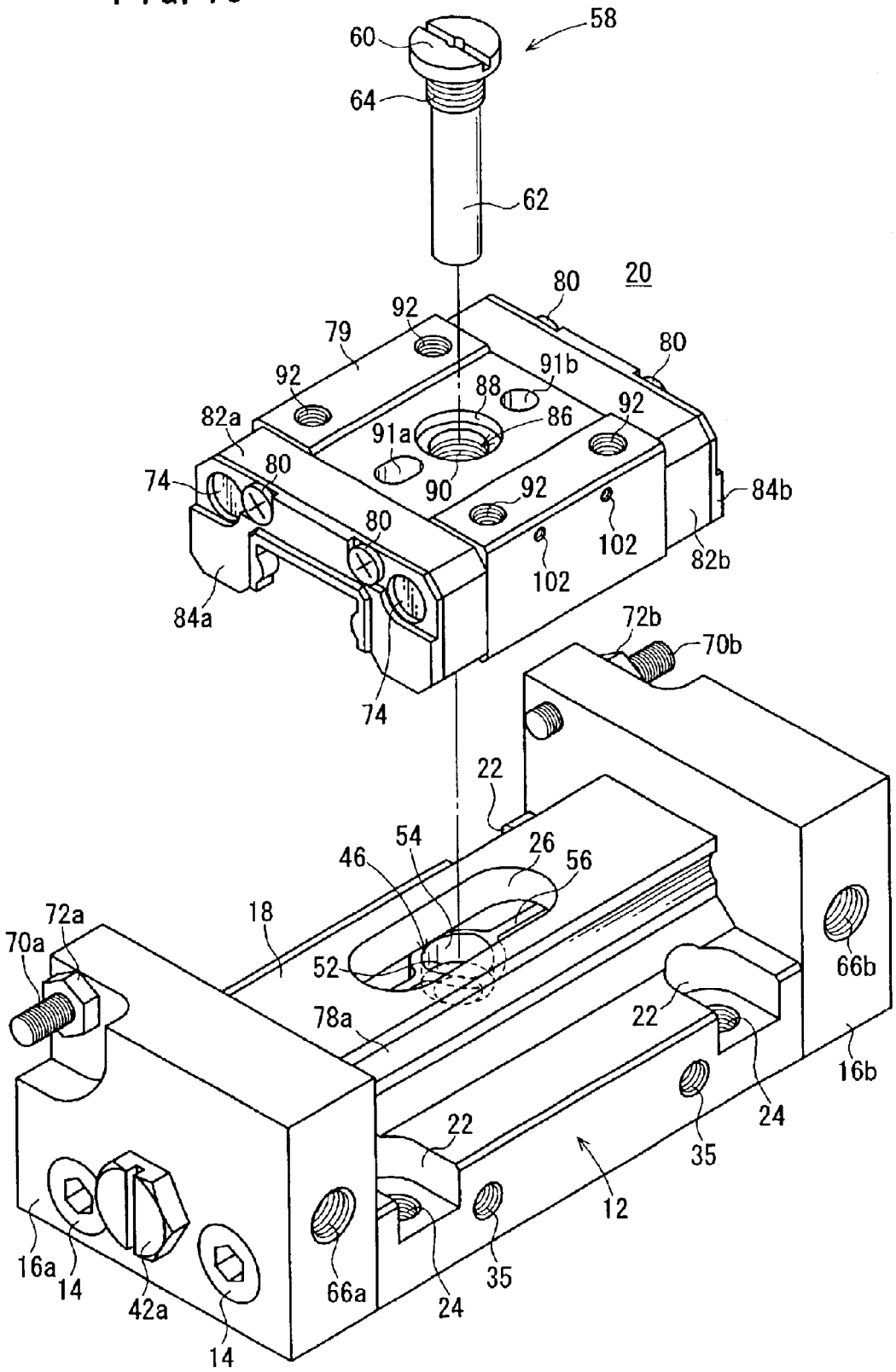
FIG. 10 is an exploded perspective view illustrating a state removed the slide table from the linear actuator shown in FIG. 1.

The fluid inlet/outlet ports 66*a*, 66*b* are formed on the side surfaces of the end blocks 16*a*, 16*b* which are connected to the actuator body 12 (see FIG. 10). The fluid inlet/outlet ports 66*a*, 66*b* are communicated with the inside of the screw holes 40*a*, 40*b* via communication passages 68*a*, 68*b* (see FIG. 2).

As shown in FIG. 2, stoppers 70*a*, 70*b* for adjusting the displacement amount of the slide table 20 are screw-engaged into first end surfaces of the end blocks 16*a*, 16*b*. The displacement amount of the slide table 20 is adjusted by increasing/decreasing the screwing amounts of the stoppers 70*a*, 70*b*. The displacement of the stoppers 70*a*, 70*b* is regulated under the screwing action of lock nuts 72*a*, 72*b* to be screw-engaged with the stoppers 70*a*, 70*b*.

The shock, which is applied to the slide table 20 when the slide table 20 abuts on the stoppers 70*a*, 70*b*, is mitigated by buffer members 74 (see FIG. 10) which are installed to end surfaces of end covers 82*a*, 82*b* opposed to the stoppers 70*a*, 70*b* as described later on.

A plurality of ball bearings 76, which function to effect smooth reciprocating motion of the slide table 20, are interposed at sliding portions between the slide table 20 and the guide section 18. The ball bearings 76 circulate through circulating holes 93*a*, 93*b* as described later on, while rolling along track grooves 78*a*, 78*b* which are formed opposingly on the inner wall surfaces of the guide section 18 and the slide table 20 respectively (see FIGS. 3 and 12).

As shown in FIG. 2, the pressure chambers 77*a*, 77*b*, which correspond to the diameter of the piston 46, are defined by the end surfaces 53*a*, 53*b* of the piston 46 and the end blocks 16*a*, 16*b* respectively. The pressure chambers 77*a*, 77*b* are communicated with the orifices 44*a*, 44*b* of the end blocks 16*a*, 16*b* respectively. When the pressure fluid is introduced into the pressure chamber 77*a*, 77*b* via the orifice 44*a*, 44*b*, the pressure fluid presses the end surface 53*a*, 53*b* of the piston 46. Therefore, the piston 46 is slidably displaced along the inner circumferential surfaces of the cylindrical members 45*a*, 45*b* of the actuator body 12. When the piston 46 is moved and displaced along the inner circumferential surfaces of the cylindrical members 45*a*, 45*b*, the slide table 20 makes the reciprocating motion in the axial direction of the actuator body 12 (in the direction of the arrow X or Y as shown in FIG. 2) by the rod 58 which is inserted into the engagement hole 52 of the piston 46.

Figure 12:
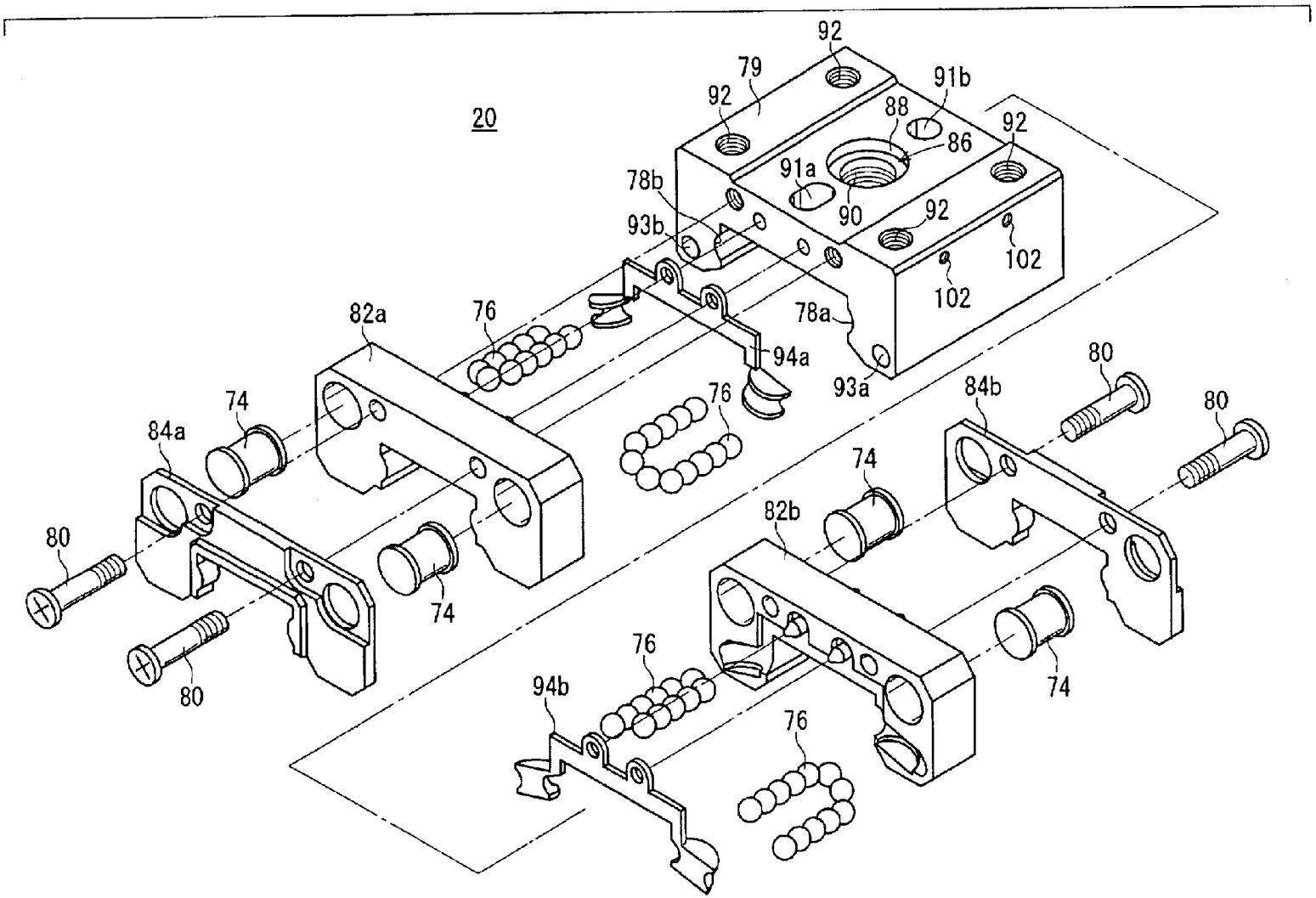
FIG. 12 is an exploded perspective view illustrating the slide table which constitutes the linear actuator shown in FIG. 10.

As shown in FIG. 12, the slide table 20 has a table block 79 which is formed to have a substantially U-shaped cross section, and a pair of end covers 82*a*, 82*b* and a pair of scrapers 84*a*, 84*b* which are installed to both ends of the table block 79 in the displacement direction of the table block 79 by screw members 80.

The rod attachment hole 86 is formed at a substantially central portion of the upper surface of the table block 79. The rod attachment hole 86 comprises a diametrally expanded section 88 which is formed to have substantially the same diameter as that of the head 60 of the rod 58 on the upper surface, and a screw thread 90 which has a smaller diameter than a diameter of the diametrally expanded section 88 and which is engaged with the rod 58. The depth of the diametrally expanded section 88 is set such that the head 60 of the rod 58 does not protrude to the outside from the upper surface of the slide table 20 when the head 60 of the rod 58 is accommodated.

Positioning holes 91*a*, 91*b*, which are disposed on a straight line in the axial direction of the table block 79, are formed while being separated from the rod attachment hole 86 by predetermined spacing distances on the upper surface of the table block 79. Workpiece attachment holes 92 are formed at four positions on the both sides separated by predetermined spacing distances from the positioning holes 91*a*, 91*b*. When an unillustrated workpiece is connected by bolts or the like, the workpiece can be positioned easily by positioning the workpiece and the positioning holes 91*a*, 91*b* of the table block 79 by unillustrated positioning pins.

The pair of circulating holes 93*a*, 93*b*, which penetrate in the displacement direction of the table block 79, are formed through the table block 79. The ball bearings 76 roll along the track grooves 78*a*, 78*b*, and they circulate through the circulating holes 93*a*, 93*b*. A pair of return guides 94*a*, 94*b*, which bridge the track grooves 78*a*, 78*b* and the circulating holes 93*a*, 93*b* when the ball bearings 76 roll, are provided on the end surfaces of the table block 79.

On the other hand, as shown in FIGS. 3 and 4, a magnet 98, which is held by an attachment fixture 96 having a substantially U-shaped cross section, is provided on the side surface of the table block 79 so that the magnet 98 faces the recess 38 of the rail member 34. The attachment fixture 96 is fixed by screw-engaging screw members 100 into screw holes 102 of the table block 79.

As a result, the magnetic field of the magnet 98 which is displaced integrally with the table block 79 is sensed by an unillustrated sensor installed to the sensor attachment groove 32*a*, 32*b*. Accordingly, the position of the slide table 20 can be detected.

The linear actuator 10 according to the embodiment of the present invention is basically constructed as described above. Next, its operation, function, and effect will be explained.

At first, an explanation will be made about a method for assembling the slide table 20, the piston 46, and the rod 58.

As shown in FIG. 10, the rod 58 and the slide table 20 are integrally connected by inserting the rod 58 into the rod attachment hole 86 disposed at the substantially central portion of the slide table 20 from a position thereover to effect the screw engagement. In this situation, the head 60 of the rod 58 is accommodated in the diametrally expanded section 88 of the rod attachment hole 86. Therefore, the head 60 of the rod 58 does not protrude to the outside from the upper surface of the slide table 20 (see FIGS. 2 and 3).

Subsequently, the rod 58, which has been integrally connected to the slide table 20, is inserted into the engagement hole 52 of the piston 46 via the substantially elliptical opening 26 of the actuator body 12 so that the slide table 20 is disposed at an upper position of the actuator body 12 (see FIG. 10). The engagement hole 52 has the guide hole 54 in which the diameter of the end portion of the guide hole 54 is expanded to the engagement hole 52. Therefore, the shaft section 62 is inserted more easily.

Finally, the slide table 20 is placed on the upper surface of the guide section 18 of the actuator body 12 in a state in which the shaft section 62 of the rode 58 is inserted into the engagement hole 52.

As described above, in the embodiment of the present invention, the shaft section 62 of the rod 58 integrally connected to the slide table 20 is inserted into the engagement hole 52 of the piston 46, and thus the rod 58 can be conveniently inserted into the piston 46. Therefore, it is possible to improve the assembling operability for the linear actuator 10.

The slight clearance is provided between the engagement hole 52 and the shaft section 62 of the rod 58. Accordingly, when the rod 58 is inserted into the engagement hole 52 to assemble the linear actuator 10, the rod 58 can be inserted more easily to assemble the piston 46 and the slide table 20. Even when the axis of the piston 46 is deviated from the axis of the slide table 20 substantially in parallel, then any displacement discrepancy between the piston 46 and the slide table 20 is absorbed by the clearance, and thus the slide table 20 can be smoothly displaced to the actuator body 12.

Further, the rod 58 is inserted into the piston 46 via the substantially elliptical opening 26, and the elliptical opening 26 functions as a guide for the rod 58. Therefore, it is possible to perform the rectilinear reciprocating motion of the slide table 20 more reliably.

When the linear actuator 10 having been assembled as described above is operated, the pressure fluid (for example, compressed air) is introduced into one fluid inlet/outlet port 66*a* via a tube or the like from an unillustrated fluid supply source. In this situation, the other fluid inlet/outlet port 66*b* is in a state of being open to the atmospheric air under the switching action of an unillustrated directional control valve.

The pressure fluid is supplied into the screw hole 40*a* via the communication passage 68 communicating with the fluid inlet/outlet port 66*a* (see FIG. 2). Further, the pressure fluid is introduced into the pressure chamber 77*a* closed by the piston 46 via the orifice 44*a* communicating with the screw hole 40*a*, and the pressure fluid presses the end surface 53*a* of the piston 46. Therefore, the piston 46, which is pressed by the pressure fluid, is slidably displaced in the direction of the actuator body 12 (direction of the arrow Y as shown in FIG. 2) to make separation from the end block 16*a* while maintaining the state in which the air-tightness of the pressure chamber 77*a* is retained by the seal member 50. As a result, the slide table 20 is displaced in the direction of the arrow Y by the rod 58 inserted into the engagement hole 52 of the piston 46. In this situation, the pressure chamber 77*b*, which is closed by the piston 46, is in a state of being open to the atmospheric air.

The slide table 20, which is displaced in the direction of the arrow Y, has the displacement terminal end position which is regulated by the abutment of the buffer member 74 against the stopper 70*b*. On the other hand, the unillustrated sensor, which is installed to the sensor attachment groove 32*a*, 32*b*, senses the magnetic field of the magnet 98 to detect the arrival of the slide table 20 at one displacement terminal end position thereby.

When the slide table 20 is displaced in a direction (direction of the arrow X) opposite to the above, the pressure fluid is supplied to the other fluid inlet/outlet port 66*b* from the unillustrated fluid supply source. The supplied pressure fluid is introduced into the pressure chamber 77*b* via the screw hole 40*b* and the orifice 44*b* to press the end surface of the piston 46. Accordingly, the piston 46 is displaced in the direction of the arrow X. As a result, the slide table 20 is displaced integrally in the direction of the arrow X by the rod 58 inserted into the engagement hole 52 of the piston 46.

As described above, in the embodiment of the present invention, the slide table 20 and the piston 46 can be integrally connected in the axial direction of the actuator body 12 to effect the displacement by only the convenient operation in which the rod 58 is integrally connected to the substantially central portion of the slide table 20, and the shaft section 62 of the rod 58 is inserted into the engagement hole 52 of the piston 46. As a result, it is possible to improve the assembling operability for the slide table 20 and the piston 46.

The piston 46, which is installed in the through-hole 28, has the integrated shape. Accordingly, it is possible to reduce the number of parts of the linear actuator 10, and it is possible to perform the cost for producting the linear actuator 10 inexpensively.

The diameter of the engagement hole 52 into which the rod 58 is inserted is formed to be larger than the diameter of the shaft section 62 of the rod 58, while having the substantially elliptical cross section. Accordingly, the shaft section 62 is inserted into the engagement hole 52 more easily. Even when the axial center of the rod 58 connected to the slide table 20 is deviated, the eccentricity of the axial center of the rod 58 can be absorbed, because the engagement hole 52 is formed to have the substantially elliptical cross section.

The positioning holes 30*a*, 30*b* of the actuator body 12 are closed by inserting close the cylindrical members 45*a*, 45*b* to the through-hole 28 of the actuator body 12. Therefore, it is possible to avoid the increase in sliding resistance of the piston 46 which would be otherwise caused such that any dust or the like enters the inside of the through-hole 28 from the outside of the actuator body 12.

On the other hand, any dust or the like, which is generated in the through-hole 28, is not discharged to the outside via the positioning holes 30*a*, 30*b*. Further, when the cylindrical members 45*a*, 45*b* are inserted close into the through-hole 28 of the actuator body 12, it is unnecessary to apply any machining to the inner circumferential surface of the through-hole 28. Thus, it is possible to shorten the time required for the production.

When the positioning holes 30*a*, 30*b* are provided on the identical axis on the bottom surface of the actuator body 12, the actuator body 12 successfully has the symmetrical shape with respect to the axis of the actuator body 12. Therefore, for example, when the actuator body 12 is attached to unillustrated positioning pins or the like provided on a plane, the positioning can be performed conveniently without considering the orientation of attachment of the actuator body 12.

Although certain preferred embodiments of the present invention have been shown and described in detail, it should be understood that various changes and modifications may be made therein without departing from the scope of the appended claims.

What is claimed is:

1. A linear actuator for effecting reciprocating motion of a slider in an axial direction of a body by introducing a pressure fluid from either of fluid inlet/outlet ports, said linear actuator comprising:

said body which has a through-hole penetrating in said axial direction, said body having a guide section extending in said axial direction, wherein said slider is movably supported on said guide section for reciprocating movement in said axial direction;

an opening formed on a surface of said body penetrating through said guide section and facing said slider in order to communicate with said through-hole;

a piston which is provided displaceably in said axial direction in said through-hole; and a rod which is connected to said slider extending in a direction substantially perpendicular to said axial direction, said rod being inserted via said opening into an engagement hole formed in said piston and extending in said direction substantially perpendicular to said axial direction.

2. The linear actuator according to claim 1, wherein a diameter of said engagement hole is larger than a diameter of said rod inserted into said engagement hole.

3. The linear actuator according to claim 2, wherein said diameter of said engagement hole is formed such that a size in a direction perpendicular to said axial direction is larger than a size in said axial direction.

4. The linear actuator according to claim 1, wherein said piston is integrally formed by using a resin material.

5. The linear actuator according to claim 1, wherein cylindrical members are inserted into said through-hole, and said piston is provided slidably along inner wall surfaces of said cylindrical members.

6. The linear actuator according to claim 1, wherein two or more positioning holes are formed on a same axis as the axis of said body, on a surface of said body opposite to said surface of said body facing said slider.

7. The linear actuator according to claim 5, wherein said piston is formed with a rib which protrudes radially outwardly from said piston.

8. The linear actuator according to claim 7, wherein a plurality of said ribs are formed while being separated from each other by predetermined angles in a circumferential direction of said piston.

9. The linear actuator according to claim 7, wherein said piston is provided slidably on said inner wall surfaces of said cylindrical members by said rib.

10. The linear actuator according to claim 6, wherein said positioning holes are closed by a pair of cylindrical members which are inserted into said through-hole while being separated from each other by a predetermined spacing distance.

11. The linear actuator according to claim 1, wherein an adjusting hole having a non-circular cross section is formed at an end of said piston.

12. The linear actuator according to claim 1, wherein ball rolling grooves are provided respectively in said slider and said guide section, and balls are disposed in said ball rolling grooves for rolling engagement between said slider and said guide section.

13. The linear actuator according to claim 1, wherein said engagement hole penetrates through said piston in said direction substantially perpendicular to said axial direction and comprises a pair of guide holes opening on respective sides of said piston.

14. A linear actuator for effecting reciprocating motion of a slider in an axial direction of a body by introducing a pressure fluid from either of fluid inlet/outlet ports, said linear actuator comprising:

said body which has a through-hole penetrating in said axial direction and which has an opening formed on a surface of said body facing said slider in order to communicate with said through-hole;

a piston which is provided displaceably in said axial direction in said through-hole; and a rod which is connected to said slider extending in a direction substantially perpendicular to said axial direction, said rod being inserted via said opening into an engagement hole formed in said piston and extending in said direction substantially perpendicular to said axial direction, wherein a diameter of said engagement hole is larger than a diameter of said rod inserted into said engagement hole, said diameter of said engagement hole being formed such that a size in a direction perpendicular to said axial direction is larger than a size in said axial direction.

15. A linear actuator for effecting reciprocating motion of a slider in an axial direction of a body by introducing a pressure fluid from either of fluid inlet/outlet ports, said linear actuator comprising:

said body which has a through-hole penetrating in said axial direction and which has an opening formed on a surface of said body facing said slider in order to communicate with said through-hole;

a piston which is provided displaceably in said axial direction in said through-hole; and a rod which is connected to said slider extending in a direction substantially perpendicular to said axial direction, said rod being inserted via said opening into an engagement hole formed in said piston and extending in said direction substantially perpendicular to said axial direction, wherein said piston is formed with a rib which protrudes radially outwardly from said piston.

16. The linear actuator according to claim 15, wherein a plurality of said ribs are formed while being separated from each other by predetermined angles in a circumferential direction of said piston.

17. The linear actuator according to claim 15, wherein cylindrical members are inserted into said through-hole, and said piston is provided slidably along inner wall surfaces of said cylindrical members, said piston being provided slidably on said inner wall surfaces of said cylindrical members by said rib.

18. A linear actuator for effecting reciprocating motion of a slider in an axial direction of a body by introducing a pressure fluid from either of fluid inlet/outlet ports, said linear actuator comprising:

said body which has a through-hole penetrating in said axial direction and which has an opening formed on a surface of said body facing said slider in order to communicate with said through-hole;

a piston which is provided displaceably in said axial direction in said through-hole; and a rod which is connected to said slider extending in a direction substantially perpendicular to said axial direction, said rod being inserted via said opening into an engagement hole formed in said piston and extending in said direction substantially perpendicular to said axial direction, wherein two or more positioning holes are formed on a same axis as the axis of said body, on a surface of said body opposite to said surface of said body facing said slider, said positioning holes being closed by a pair of cylindrical members which are inserted into said through-hole while being separated from each other by a predetermined spacing distance.

19. A linear actuator for effecting reciprocating motion of a slider in an axial direction of a body by introducing a pressure fluid from either of fluid inlet/outlet ports, said linear actuator comprising:

said body which has a through-hole penetrating in said axial direction and which has an opening formed on a surface of said body facing said slider in order to communicate with said through-hole;

a piston which is provided displaceably in said axial direction in said through-hole; and a rod which is connected to said slider extending in a direction substantially perpendicular to said axial direction, said rod being inserted via said opening into an engagement hole formed in aaid piston and extending in said direction substantially perpendicular to said axial direction, wherein an adjusting hole having a non-circular cross section is formed at an end of said piston.

* * * * *